US005407408A

United States Patent [19]

Wilkinson

[11] Patent Number: 5,407,408

[45] Date of Patent: Apr. 18, 1995

[54] COMBINATION TREADMILL AND TWISTER EXERCISE DEVICE

[76] Inventor: William T. Wilkinson, Severnside Farm, 300 Kyle Rd., Crownsville, Md. 21032-0572

[21] Appl. No.: 183,741

[22] Filed: Jan. 21, 1994

[51] Int. Cl.[6] ..... A63B 22/02

[52] U.S. Cl. ..... 482/54; 482/51; 482/147

[58] Field of Search ..... 482/54, 147, 51, 146

[56] References Cited

U.S. PATENT DOCUMENTS

| | | | |
|---|---|---|---|
| 3,501,140 | 3/1970 | Eichorn | 482/54 |
| 4,679,787 | 7/1987 | Guilbault | 482/54 |
| 5,078,389 | 1/1992 | Chen | 482/147 |
| 5,110,117 | 5/1992 | Fisher et al. | 422/54 |
| 5,135,458 | 8/1992 | Huang | 482/54 |
| 5,226,866 | 7/1993 | Engel et al. | 482/54 |

*Primary Examiner*—Richard J. Apley
*Assistant Examiner*—Lynne A. Reichard
*Attorney, Agent, or Firm*—Connolly & Hutz

[57] ABSTRACT

A combination treadmill/twister exercise device comprises a treadmill having a base frame and a pair of spaced shafts with an endless belt rotatably mounted over the shafts. The twister unit comprises a support frame having a rotatable platform mounted to the support frame. The twister unit is selectively in an operative location and in a storage location. The support frame is mounted to the base frame to dispose the rotatable platform above the endless belt when the twister unit is in the operative location.

10 Claims, 3 Drawing Sheets

COMBINATION TREADMILL AND TWISTER EXERCISE DEVICE

BACKGROUND OF THE INVENTION

With the ever growing trend toward health consciousness there has been an increase in the number of different types of exercises and exercise devices on the market and in use. This has lead to various specialties in exercise devices for different intended purposes. One of the disadvantages is the need or desire for multiple types of exercise devices with the attendant storage problems. Another concern is to satisfy the desirability for having the individual exercise devices conveniently at hand.

SUMMARY OF THE INVENTION

An object of this invention is to provide a combination exercise device which includes a basic device (such as a treadmill) and an auxiliary device (such as a twister unit) which could be selectively mounted to the basic device when in its operative location.

A further object of this invention is to provide a combination treadmill/twister exercise device wherein the treadmill is readily accessible for use while the twister unit is in a stored location.

In accordance with this invention a combination treadmill/twister exercise device includes a treadmill having a base frame with a pair of spaced shafts mounted to the base frame. An endless belt is rotatably mounted around the shafts. The twister unit comprises a support frame having a rotatable platform mounted to the support frame. The twister unit is selectively in an operative location and in a storage location. The support frame is mounted to the base frame to dispose the rotatable platform above the endless belt when the twister unit is in the operative location.

In one embodiment of this invention the twister unit is detachably mounted to the treadmill so that it can be completely detached from the treadmill when the twister unit is in its storage location.

The twister unit may be adjustably mounted with respect to the treadmill to vary the precise position of its operative location. Alternatively, the twister unit may be permanently mounted to the treadmill, but movable to and from the operative location and the storage location. This can be accomplished by having the flat support frame of the twister unit hinged to the treadmill frame or by having the treadmill frame of extended length to extend beyond the endless belt a sufficient distance to accommodate the twister unit so that the twister unit can still be mounted to the treadmill base frame and yet have the rotatable platform of the twister unit not disposed over the endless belt.

THE DRAWINGS

DETAILED DESCRIPTION

The present invention is directed to a combination exercise device which includes a base type exercise device which generally occupies a relatively large area and an auxiliary exercise device which would occupy a lesser area. The invention involves the mounting of the auxiliary exercise device to the base exercise device so that the auxiliary exercise device is selectively in an operative location and in a storage location. When in the operative location the auxiliary exercise device would be mounted directly to the base exercise device over the foot contact surface of the base exercise device.

In a preferred practice of this invention the base exercise device is a treadmill and the auxiliary exercise device is a twister unit. As later described, however, other forms of base exercise devices and auxiliary exercise devices may be used within the concepts of this invention.

FIGS. 1–8 and 15–16 relate to one practice of this invention wherein the combination exercise device 10 includes a treadmill 12 having a twister unit 14 detachably mounted to the treadmill so that the twister unit could be selectively mounted in an operative location directly above the endless belt 16 of the treadmill or completely detached to be stored at any suitable location. Where there is sufficient clearance below the treadmill, the twister unit 14 could even be stored beneath the treadmill.

Figure 2:
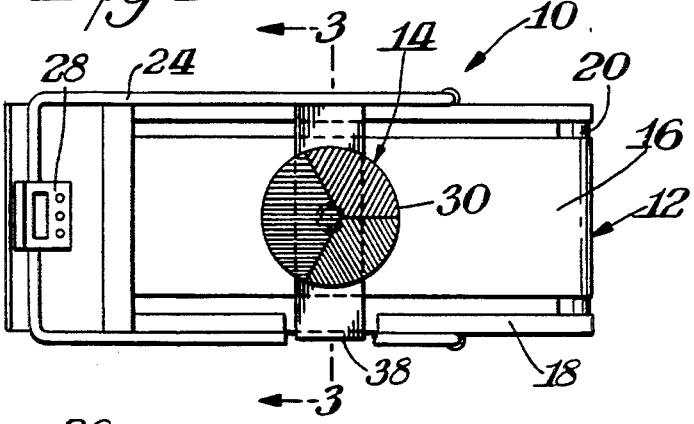
FIG. 2 is a top plan view of the device shown in FIG. 1.

Treadmill 12 could take any suitable form. As illustrated treadmill 12 includes a frame 18 having a pair of shafts 20 (only one of which is shown in FIG. 2) around which the endless belt 16 would rotate in a known manner. In the illustrated form treadmill 12 also includes hand side rails 24 which extend upwardly and toward the front of treadmill 12 to join at center post 26 having the known type of electronic display unit 28.

It is to be understood that the above description and the illustrations for treadmill 12 are merely for exemplary purposes and are not intended to limit the invention. Any other suitable form of treadmill may be used in accordance with this invention including the types described in U.S. Pat. No. 5,207,622 the details of which are incorporated herein by reference thereto.

The twister unit 14 may also take any suitable form. In general, twister unit 14 includes a rotatable platform 30 which is preferably in the form of a disk having a non-slip upper surface. Platform 14 is mounted on a shaft 32 above support frame 34. Support frame 34 includes a horizontal member 36 with a pair of downwardly extending side projections 38 in the form illustrated in FIGS. 1–8.

Figure 4:
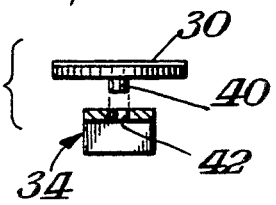
FIG. 4 is a partial sectional view showing the twister platform removed from the twister support frame in an alternative form of this invention.
Figure 3:
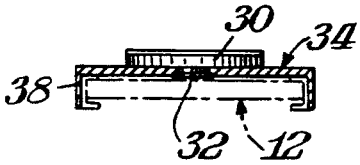
FIG. 3 is a cross-sectional view taken through FIG. 2 along the line 3—3.

Twister unit 14 in the manner described and illustrated herein is also for exemplary purposes since the twister unit may take any suitable form including the types of twister units described in copending application Ser. No. 56,930, filed May 5, 1993, the details of which are incorporated herein by reference thereto. FIGS. 3–4, for example, show two variations. In FIG. 3, the shaft 32 is permanently attached to frame 34 by being a stub type shaft. In FIG. 4, however, shaft 40 is detachably mounted to frame 34 by being detachably positioned in bearing 42.

Figure 5:
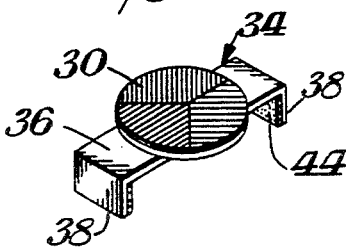
FIG. 5 is a perspective view of the twister unit shown in FIGS. 1–3.
Figure 1:
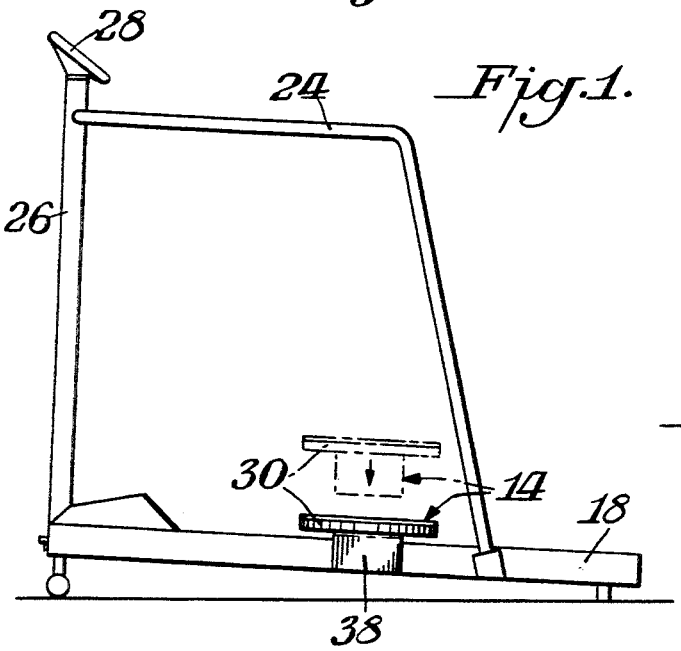
FIG. 1 is a side elevational view of a combination treadmill/twister exercise device in accordance with this invention.

The detachable mounting of support frame 34 to treadmill 12 is preferably accomplished by mounting support frame 34 to the base frame 18 of the treadmill 12. It is also desirable that the location of the mounting could be adjustable so as to be able to select a location that best suits the user. FIG. 5, for example, illustrates the side walls 38 extending from upper member 36 to have a high friction coating 44 on the inner surfaces so as to avoid any tendency of the frame 34 to slide during movement. By utilizing the frictional engagement of support frame 34 to base frame 18 any suitable location of the mounting can be selected.

Figure 15:
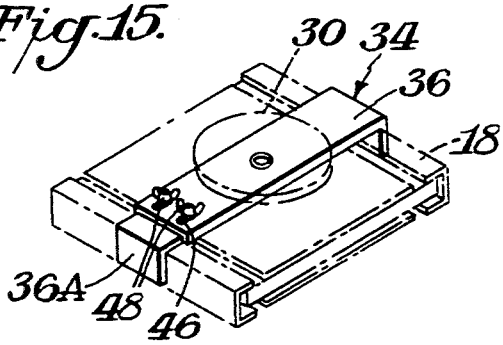
FIG. 15 is a perspective view of a portion of a modified device in accordance with this invention similar to the devices of FIGS. 1–8.

Other forms of adjustable positioning are possible, such as the inclusion of fasteners to or through side walls 38. Versions which utilize the fastening elements on the support frame 38 itself permit the support frame to be mounted to any standard type treadmill without requiring alterations to the treadmill. FIG. 15, for example, illustrates the support frame 34 to include a second horizontal member 36A telescopically positioned under main horizontal member 36 with slots 46 extending through main horizontal member 36 for receiving any suitable fasteners such as wing nuts 48 on bolts attached to underlying horizontal member 36A. This telescopic arrangement would not only permit attachment of support frame 34 to a conventional treadmill frame 18 without altering the treadmill frame but would also permit attachment to treadmill frames of varying widths.

Although a close positioning of the side wall 38 of support frame 34 with the corresponding side wall on base frame 18 is desired, the invention may be practiced where there is clearance on both side walls and reliance would be had on gravity from the weight of twister 14 in addition to the weight of the user to maintain the twister in place.

Figure 6:
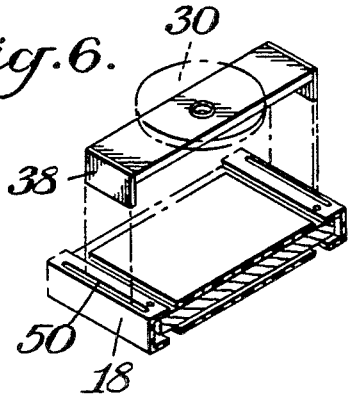
FIG. 6 is a perspective view partly in section of an alternative form of device in accordance with this invention.

FIG. 6 shows a modification of mounting the twister 14 to treadmill 12. As shown therein, treadmill frame 18 includes sets of grooves or recesses 50 into which the side walls 38 of twister 12 would be received.

Figure 7:
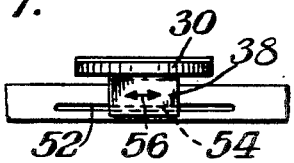
FIG. 7 is a fragmental side elevational view of yet another device in accordance with this invention.

FIG. 7 shows a further alternative wherein the treadmill frame 18 would be provided with rails or horizontal projections 52. Side walls 38 would in turn be provided with correspondingly inwardly directed lips 54 dimensioned to fit under rails 52. In order to mount or detach support frame 34 a sliding action would be used as indicated by the arrow 56.

Figure 8:
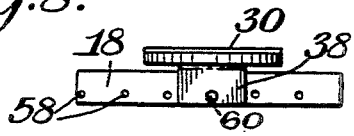
FIG. 8 is a fragmental side elevational view showing still yet another device in accordance with this invention.

FIG. 8 shows yet another form of mounting twister 14 to treadmill 12. As shown therein, base frame 18 includes a series of spaced holes or recesses 58. The side wall 38 of support frame 34 would include a fastener 60 such as a bolt, post, spring loaded pin, etc. which would fit into a selected hole. The fastener 60 would thus, not only lock the twister 14 in place, but the location could be adjusted in accordance with the particular hole 58 engaged by fastener 60.

Figure 16:
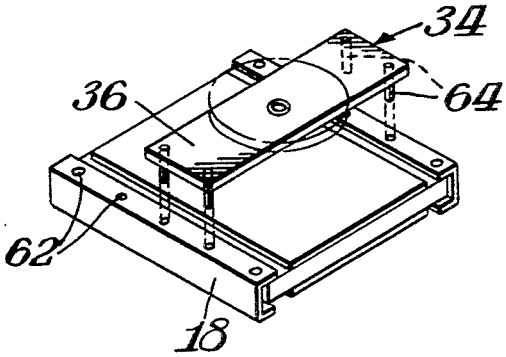
FIG. 16 is a perspective view of yet another form of device similar to that of FIG. 15.

FIGS. 6–8 provide a means for mounting the twister to the treadmill which requires special adaptations or modifications to the treadmill. FIG. 16 shows yet another form of such practice. As indicated therein, the base frame 18 includes a series of holes 62 on its upper surface. The support frame 34 does not include side walls of flat shape, such as in the other embodiments, but rather the downward projections are posts 64. As illustrated in FIG. 16 the location of mounting twister 14 to treadmill 12 would be determined by the set of holes 62 into which the posts 64 would be positioned.

The various embodiments of FIGS. 1–8 and 15–16 exemplify use of the invention where the twister unit 14 is detachably mounted to treadmill 12. Thus, during its storage condition twister 14 could be located at any suitable location completely independently of treadmill 12 including sliding the twister unit 14 under treadmill 12 where there is sufficient clearance. The significant feature is that there need be no physical attachment of twister unit 14 to treadmill 12 when twister unit 14 is being stored.

FIGS. 9–14 illustrate a variation of the invention wherein the combination treadmill/twister exercise device 10A has the twister 12 permanently attached to treadmill 12. In this practice of the invention it would be desirable to move twister unit 14 selectively to and from one of two different positions. One would be the operative position and the other would be the storage position.

Figure 11:
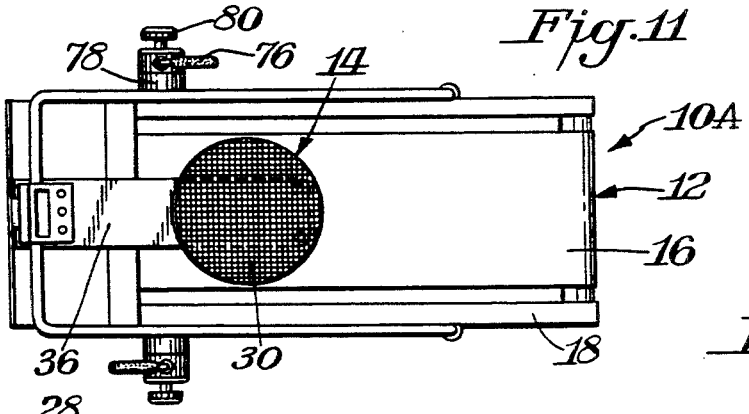
FIG. 11 is a top plan view of the device shown in FIGS. 9–10.
Figure 9:
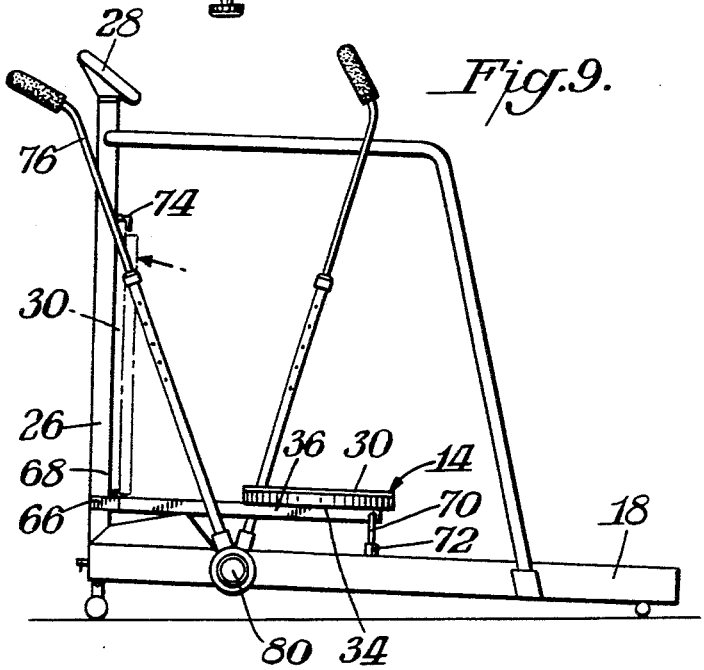
FIG. 9 is a side elevational view of a modified device in accordance with this invention.
Figure 10:
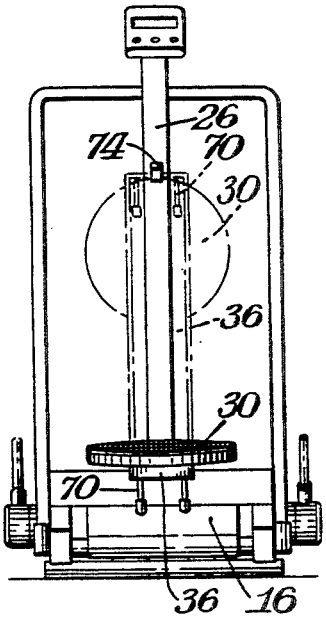
FIG. 10 is a front elevational view of the device shown in FIG. 9.

FIGS. 9–11 illustrate a practice of the invention wherein the support frame 34 for twister unit 14 includes a horizontal member 36 on which the disk 30 is mounted as previously described. As best illustrated in FIGS. 9 and 11 disk 30 would be mounted at one end of horizontal member 36. The other end of horizontal member 36 is mounted to a support bracket 66 fixedly mounted to the treadmill frame such as being mounted to the center post 26. A hinge connection 68 is utilized to connect horizontal member 36 to fixed bracket 66. In its operative location twister unit 14 could be disposed horizontally above endless belt 16 as shown in FIGS. 9 and 11. To assure the horizontal orientation, support feet 70 are provided under horizontal member 36 with cushion inserts 72 at the end of support feet 70 to minimize any damage to the endless belt 16. When it is desired to inactivate twister unit 14 horizontal member 36 is rotated upwardly toward center post 26. A latch 74 secured to center post 26 would selectively engage horizontal or upper member 36 to maintain the member 36 in a now generally vertical orientation secured to center post 26. If desired, legs 70 could also be hinged so as to permit the legs to be folded against the inner surface of member 36. The stored condition is illustrated in phantom in FIGS. 9 and 10.

A further feature illustrated in FIGS. 9–11 which may be incorporated in any of the embodiments herein, is the provision of resistance arms to the treadmill such as described in U.S. Pat. No. 5,207,622 the details of which are incorporated herein by reference thereto. In general, this feature includes having a pair of arms or poles 76 each of which is pivotally mounted on a shaft to a bracket secured to a bracket 78 secured to frame 18. An adjustment setting member 80 permits the resistance required to pivot arms 76 to be varied in the manner described in the above noted patent. As also illustrated in FIG. 9 the length of each arm 76 is adjustable by forming the arms as telescopic members.

Figure 13:
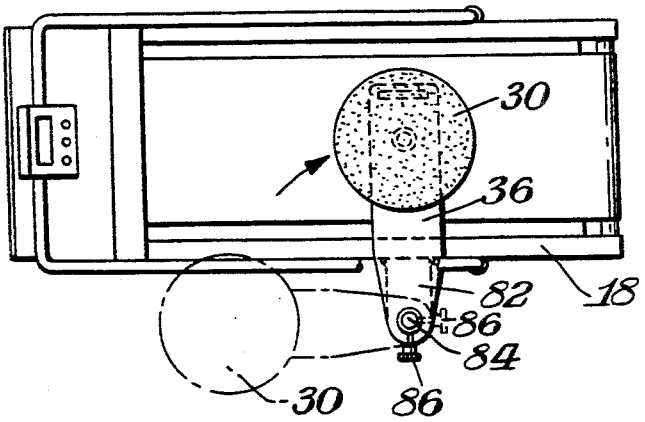
FIG. 13 is a top plan view of still yet another device in accordance with this invention.
Figure 14:
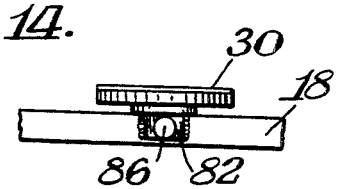
FIG. 14 is a fragmental side elevational view of a portion of the device shown in FIG. 13.

FIGS. 13–14 illustrate a variation of the device shown in FIGS. 9–11 wherein the twister unit 14 is pivoted to and from its operative location. As shown in FIGS. 13–14 the main support member 36 has the twister disk 30 mounted at one end thereof. The opposite end of member 36 is mounted to a support bracket 82 which extends from frame 18. The mounting is achieved by means of a bearing and pivot shaft 84. A lock screw or other suitable fastener 86 would lock the twister unit in its desired location. FIG. 13, for example, illustrates in solid the twister unit in its operative location and illustrates in phantom the twister unit in its storage location.

Figure 12:
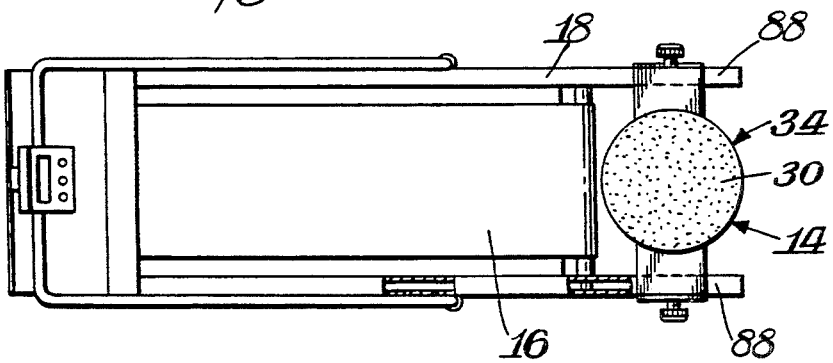
FIG. 12 is a top plan view of still yet another device in accordance with this invention.

FIG. 12 illustrates a further variation of this invention which could be classified either as having the twister unit permanently mounted to the treadmill as in the embodiments of FIGS. 9–11 and 13–14 or detachably mounted as in the other embodiments. A main difference of FIG. 12 is that the base frame 18 is of extended length which includes portions 88 that extend the overall length of frame 18 a sufficient distance beyond the end of belt 16 that there is sufficient room to accommodate twister unit 14 without having the twister unit 14 located above belt 16. The extended length provided by extension 88 could be achieved by having extensions 88 formed integral with base frame 18 during the manufacture of treadmill 12 or by having the extensions 88 as add on units which could be purchased separately by the user and then added on to the main frame by any suitable mounting members such as clamps, bolts and the like.

The embodiment of FIG. 12 could be practiced by sliding support frame 34 along the frame 18 (or extensions 88) of the treadmill to the desired location for use. Instead of a sliding mounting, any other type of mounting may be used as previously described in the embodiments of FIGS. 1–8 and 15–16. In that practice of the invention the location would be selected to be over the endless belt so that if necessary the user could make use of the hand rails 24 or the resistance arms 76. When it is desired to use the treadmill the twister unit would then be moved to a location where support frame 34 is mounted at the extensions 88 of base frame 18 so that the twister unit does not interfere with the user being on belt 16.

A further possible practice of the embodiment of FIG. 12 is to maintain the twister unit 14 at the location of extensions 88 even during periods of use of the twister unit. Thus, detachability or movability would not be required. Instead the twister and the treadmill are in effect mounted end to end by use of a common frame for selective use of either of the exercise devices or for simultaneous use by two different persons.

The components of this invention may be of any suitable size, shape and dimension and generally would use the conventional sizes and shapes with known treadmills and twister units. The support frame 34 would preferably be about 4–6 inches wide with the twister disk 30 about 12 inches in diameter for use on a treadmill approximately 20 inches wide.

As previously indicated the practice of the invention specifically with a twister unit on a treadmill represents one aspect of the invention. More broadly the invention involves mounting an auxiliary exercise device on a main or base exercise device. Other forms of auxiliary exercise devices that could be utilized could include, for example, an aerobic step, a stepper or a trampoline. An aerobic step generally would take the form of a horizontal platform, such as described in my various patents. A stepper could take any suitable form including that described in co-pending application Ser. No. 56,930 filed May 5, 1993, the details of which are incorporated herein by reference thereto. Other base devices could also be used including a trampoline as the base device. In general, the main exercise device would be one having a foot contacting surface for performing some form of leg exercise. The main exercise device would also preferably be of much larger area than the auxiliary exercise device so as to readily support the auxiliary exercise device.

It is to be understood that the various features described in any particular embodiment could be used with other embodiments within the spirit of this invention.

What is claimed is:

1. A combination treadmill and twister exercise device comprising (a) a treadmill, said treadmill having a base frame, a pair of spaced shafts mounted to said base frame, an endless belt rotatably mounted around said shafts; and (b) a twister unit, said twister unit comprising a support frame, a rotatable platform mounted to said support frame, said twister unit being selectively in an operative location and in a storage location, said support frame spanning said endless belt and extending above said base frame, said support frame being detachably mounted to said base frame for selectively disposing said rotatable platform above said endless belt when said twister unit is in said operative location and disposing said twister unit separate from said treadmill when said twister unit is in a non-use condition, and said base frame comprising both a support means for said shafts and also a support means for said twister unit when said twister unit is in said operative location.

2. The device of claim 1 wherein said support frame includes a generally horizontal member on which said platform is rotatably mounted, at least one projection extending downwardly from said horizontal member, said base frame having side walls, and each of said projections being juxtaposed a respective side wall of said base frame.

3. The device of claim 2 wherein said projections comprise side walls of said support frame, said side walls of said support frame frictionally engaging said side walls of said main frame, and said support frame being adjustably mounted to said main frame to vary said operative location of said twister unit.

4. The device of claim 2 wherein said base frame has an upper surface at each of its sides, at least one groove being in said upper surface on each of said sides, and said support frame projections being a projection at each end of said support frame of a size and shape to be received in a respective groove of said base frame.

5. The device of claim 2 wherein said support frame is provided with a plurality of sets of holes at each of its sides, and said projections being selectively mounted in different sets of holes to provide adjustability of said operative location.

6. The device of claim 2 wherein said horizontal member is of two piece telescopic construction to vary the overall length of said horizontal member whereby said horizontal member may telescope over said support frame, and locking means for locking said horizontal member in a fixed length over said support frame to permit said operative location to be varied.

7. The device of claim 2 wherein said base frame includes an outwardly extending rail on each side thereof, said support frame projections being downwardly extending side walls, and each of said side walls having an interned lip disposed under a respective rail.

8. The device of claim 1 wherein said support frame is adjustably mounted over said base frame to vary said operative location.

9. The device of claim 1 wherein said rotatable platform is a disk detachably mounted to said support frame.

10. The device of claim 1 including resistance arms rotatably mounted to said main frame.

* * * * *